US008944781B2

(12) United States Patent
Shimaguchi et al.

(10) Patent No.: US 8,944,781 B2
(45) Date of Patent: Feb. 3, 2015

(54) ELECTRICALLY DRIVEN GAS COMPRESSOR

(75) Inventors: Hirotada Shimaguchi, Saitama (JP); Toshiharu Watanabe, Saitama (JP)

(73) Assignee: Calsonic Kansei Corporation, Saitama-shi, Saitama (JP)

( * ) Notice: Subject to any disclaimer, the term of this patent is extended or adjusted under 35 U.S.C. 154(b) by 296 days.

(21) Appl. No.: 13/636,932

(22) PCT Filed: Mar. 10, 2011

(86) PCT No.: PCT/JP2011/055573
§ 371 (c)(1),
(2), (4) Date: Sep. 24, 2012

(87) PCT Pub. No.: WO2011/125406
PCT Pub. Date: Oct. 13, 2011

(65) Prior Publication Data

US 2013/0011281 A1 Jan. 10, 2013

(30) Foreign Application Priority Data

Apr. 1, 2010 (JP) ..... 2010-085427

(51) Int. Cl.

| | |
|---|---|
| ***F04B 39/02*** | (2006.01) |
| ***F04C 29/02*** | (2006.01) |
| ***F04C 29/12*** | (2006.01) |
| ***F04B 35/04*** | (2006.01) |
| ***F04C 18/344*** | (2006.01) |
| ***F04C 23/00*** | (2006.01) |

(52) U.S. Cl.
CPC ..... *F04B 35/04* (2013.01); *F04B 39/0238* (2013.01); *F04B 39/0276* (2013.01); *F04C 18/3446* (2013.01); *F04C 23/008* (2013.01); *F04C 29/028* (2013.01); *F04C 29/12* (2013.01)
USPC ..... 417/371; 417/410.3; 417/423.14

(58) Field of Classification Search
USPC ..... 417/371, 423.7, 410.3, 423.14
See application file for complete search history.

(56) References Cited

U.S. PATENT DOCUMENTS

| | | | | |
|---|---|---|---|---|
| 1,967,035 | A * | 7/1934 | Lipman | 417/372 |
| 7,077,633 | B2 * | 7/2006 | Yoda | 417/371 |
| 2004/0005229 | A1 | 1/2004 | Yoda | |
| 2012/0224986 | A1 * | 9/2012 | Shimaguchi et al. | 417/410.3 |

FOREIGN PATENT DOCUMENTS

| | | | |
|---|---|---|---|
| JP | 61-053488 | A | 3/1986 |
| JP | 08-219063 | A | 8/1996 |
| JP | 10-037706 | A | 2/1998 |
| JP | 2004-036455 | A | 2/2004 |
| JP | 2005-344658 | A | 12/2005 |

* cited by examiner

*Primary Examiner* — Bryan Lettman
(74) *Attorney, Agent, or Firm* — Foley & Lardner LLP

(57) ABSTRACT

A horizontal type electrically driven gas compressor includes an electric motor installed in a suction chamber of a housing, a gas compression mechanism section installed in the housing and driven by the electric motor, a sucked refrigerant guide path for guiding a refrigerant from the suction chamber to the gas compression mechanism section, and a lubricating oil supply path for supplying a lubricating oil, which has been collected and stagnated in a bottom portion of the suction chamber, to the sucked refrigerant guide path, the lubricating oil supply path fluidly connecting the sucked refrigerant guide path and the bottom portion of the suction chamber at the position of the bottom portion of the suction chamber.

2 Claims, 6 Drawing Sheets

ELECTRICALLY DRIVEN GAS COMPRESSOR

TECHNICAL FIELD

The present invention relates to a horizontal type electrically driven gas compressor that is installed in an air conditioning device of a motor vehicle and constructed to have a compression mechanical section, an electric motor for driving the compression mechanical section and a housing for housing therein the compression mechanical section and the electric motor.

BACKGROUND ART

In Patent Document 1, there is shown an arrangement in which, for cooling an electric motor as a drive source of a gas compression mechanical section by using a flow of sucked refrigerant in a housing, the electric motor is installed in a suction chamber that is communicated with a suction port of the housing.

When the gas compression mechanism section is driven by the electric motor, the refrigerant is sucked from the suction port of the housing to the gas compression mechanism section through the suction chamber and the refrigerant thus compressed by the gas compression mechanism section is discharged to the outside from a discharge port provided by the housing.

Although the refrigerant sucked into the housing contains a lubricating oil for lubricating the gas compression mechanical section, part of the lubricating oil is separated from the refrigerant in the suction chamber and thus it sometimes occurs that the separated lubricating oil is collected in the bottom portion of the suction chamber.

If the amount of the separated lubricating oil collected and stagnated in the bottom portion of the suction chamber is increased, the amount of lubricating oil fed to the gas compression mechanism section is reduced, which induces a difficulty in obtaining a smoothed operation of the gas compression mechanism section.

In view of the above, Patent Document 1 proposes an arrangement which comprises a refrigerant guide path that guides the refrigerant sucked to the suction chamber to the gas compression mechanism section and a lubricating oil guide path that has one end opened to the bottom portion of the suction chamber and the other end opened to the refrigerant guide path, wherein due to the flow of the refrigerant in the refrigerant guide path, the lubricating oil collected in the bottom portion of the suction chamber is moved or brought to the gas compression mechanism section through the lubricating oil guide path.

With the above-mentioned arrangement, undesired liquid compression at the time of restarting the gas compression mechanism is avoided and collection and stagnation of the lubricating oil in the suction chamber is also avoided.

PRIOR ART DOCUMENT

Patent Document

Patent Document 1: Japanese Laid-open Patent Application (Tokkai) 2005-344658

SUMMARY OF INVENTION

The arrangement proposed by the above-mentioned conventional technique is of a type that practically uses a so-called venture effect, wherein by using a pressure reduction in the refrigerant guide path caused by movement of the refrigerant flowing in the refrigerant guide path, the lubricating oil is sucked through the lubricating oil guide path. Accordingly, in a low speed operation condition of the gas compressor wherein the amount of refrigerant flowing in the refrigerant guide path is small, there is a possibility of failing to feed the gas compressor with a sufficient amount of lubricating oil.

In view of the above-mentioned undesired possibility, the present invention aims to provide an electrically driven gas compressor in which the lubricating oil is not collected in the bottom portion of the housing even when the compressor is being operated at a lower speed.

An electrically driven gas compressor according to the present invention comprises an electric motor installed in a suction chamber defined in a housing, the suction chamber being communicated with a suction port provided by the housing; a gas compression mechanism section installed in the housing and driven by the electric motor; a sucked refrigerant guide path for guiding a lubricating oil-impregnated refrigerant from the suction chamber to the gas compression mechanism section, the sucked refrigerant guide path including one open end exposed to an upper portion of the suction chamber, a middle portion running through a bottom portion of the suction chamber and the other open end connected to an inlet opening of the gas compression mechanism section; and a lubricating oil supply path for supplying a lubricating oil, which has been collected in the bottom portion of the suction chamber, to the sucked refrigerant guide path, the lubricating oil supply path fluidly connecting the sucked refrigerant guide path and the bottom portion of the suction chamber at the position of the bottom portion of the suction chamber.

In the electrically driven gas compressor according to the present invention, a liquid, such as the lubricating oil or the like, collected in the bottom portion of the suction chamber is led or fed to the sucked refrigerant guide path through the lubricating oil supply path that fluidly connects the sucked refrigerant guide path and the bottom portion of the suction chamber at the position of the bottom portion of the suction chamber.

The liquid is led or moved to the sucked refrigerant guide path because of two forces, one being the force produced by a pressure difference between the interior of the suction chamber and the interior of the sucked refrigerant guide path caused by a pressured reduction caused by the flow of the refrigerant in the sucked refrigerant guide path and the other being the force produced by its own weight.

As a result, even if the lubricating oil and a liquefied refrigerant are collected in the bottom portion of the suction chamber, it never occurs that only these liquids are fed to the gas compression mechanism section. Furthermore, even in a low speed operation condition, it never occurs that the lubricating oil and the liquefied refrigerant are collected and stagnated in the bottom portion of the suction chamber.

Furthermore, the electrically driven gas compressor of the present invention can have such a construction that the one open end of the refrigerant guide path is oriented to face the rotation direction of the electric motor and exposed to the suction chamber.

According to such construction, the one open end of the refrigerant guide path is permitted to suck only the refrigerant that is free of the lubricating oil, and thus, the amount of the lubricating oil in the refrigerant fed to the gas compression mechanism section can be made stable.

According to the present invention, it is possible to prevent the lubricating oil from being collected in the suction chamber without the aid of the rotation speed of the electrically driven gas compressor, and it is possible to prevent undesired liquid compression that would occur at restarting of the electrically driven gas compressor. Accordingly, malfunction of the gas compression mechanism section caused by lack of lubricating oil fed to the gas compressing mechanism section can be avoided and noises and vibration that would be produced by the liquid compression can be avoided.

EMBODIMENTS OF THE INVENTION

In the following, embodiments of the present invention will be described with reference to the accompanying drawings.

First Embodiment

Figure 1:
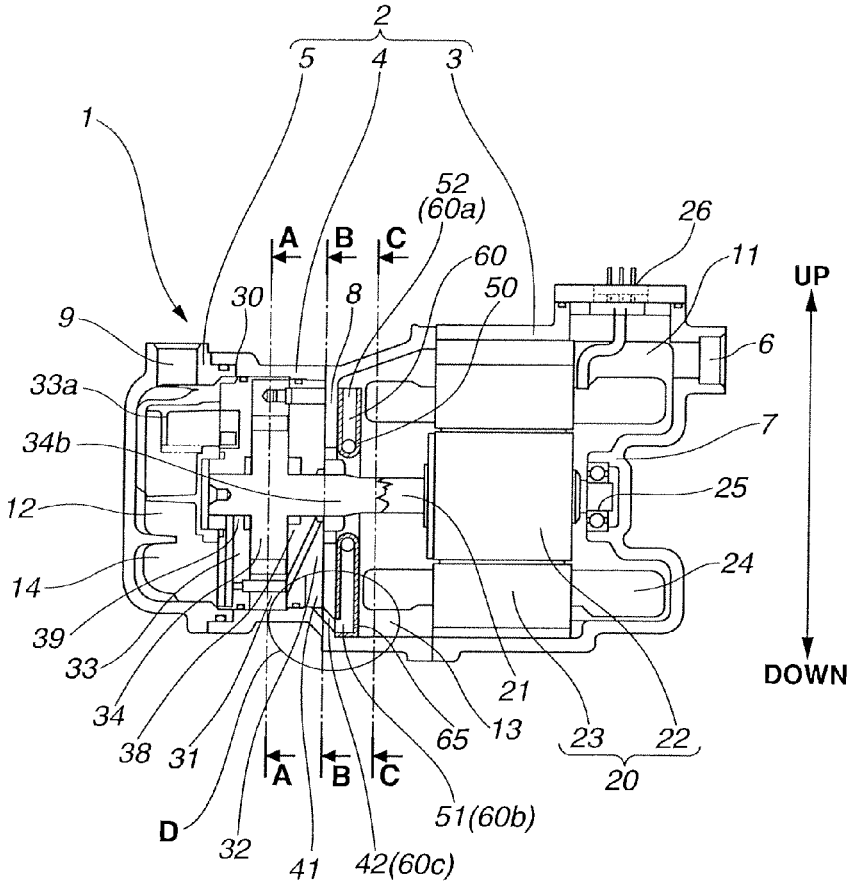
FIG. 1 a vertically sectioned view of a horizontal type electrically driven gas compressor that is a first embodiment of the present invention.
Figure 2:
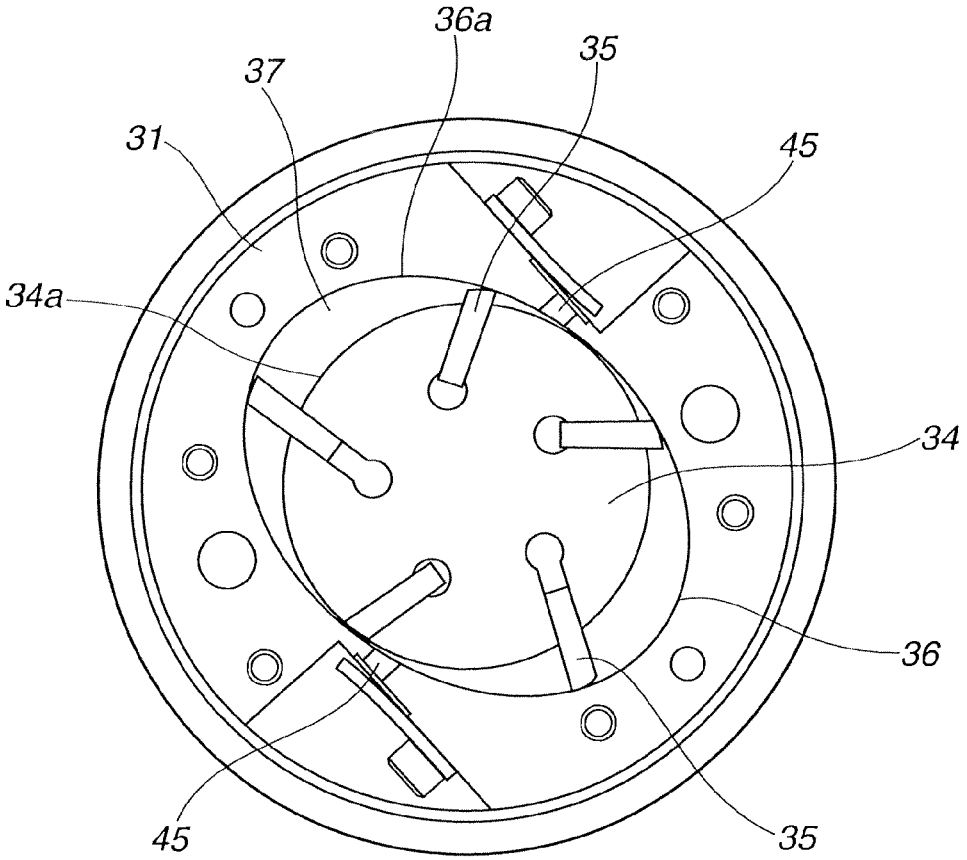
FIG. 2 is a sectional view taken along the line A-A of FIG. 1.
Figure 3:
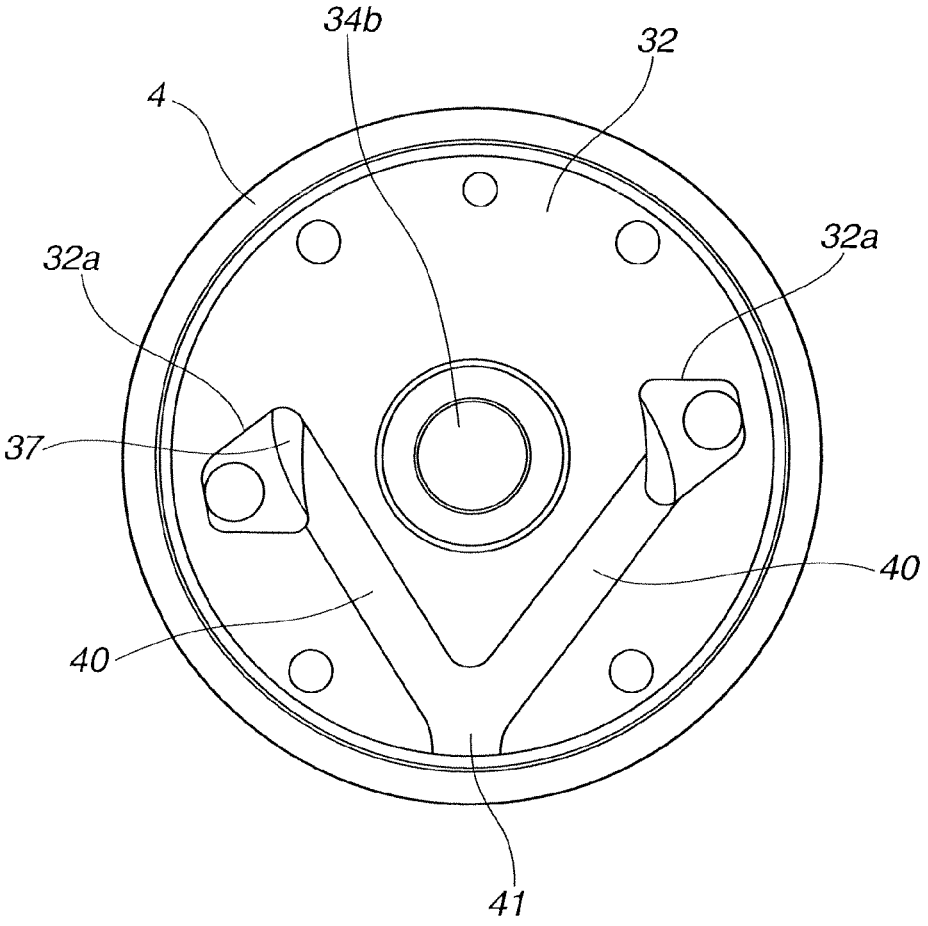
FIG. 3 is a sectional view taken along the line B-B of FIG. 1.
Figure 4:
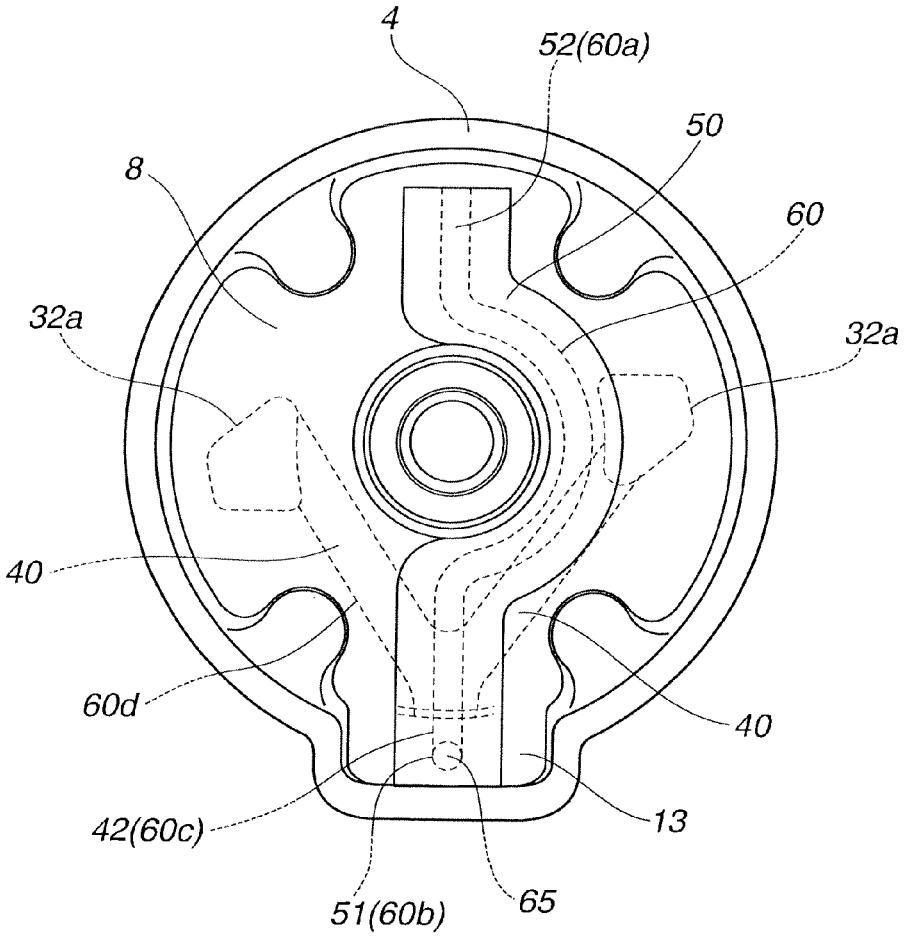
FIG. 4 is a sectional view taken along the line C-C of FIG. 1.
Figure 5:
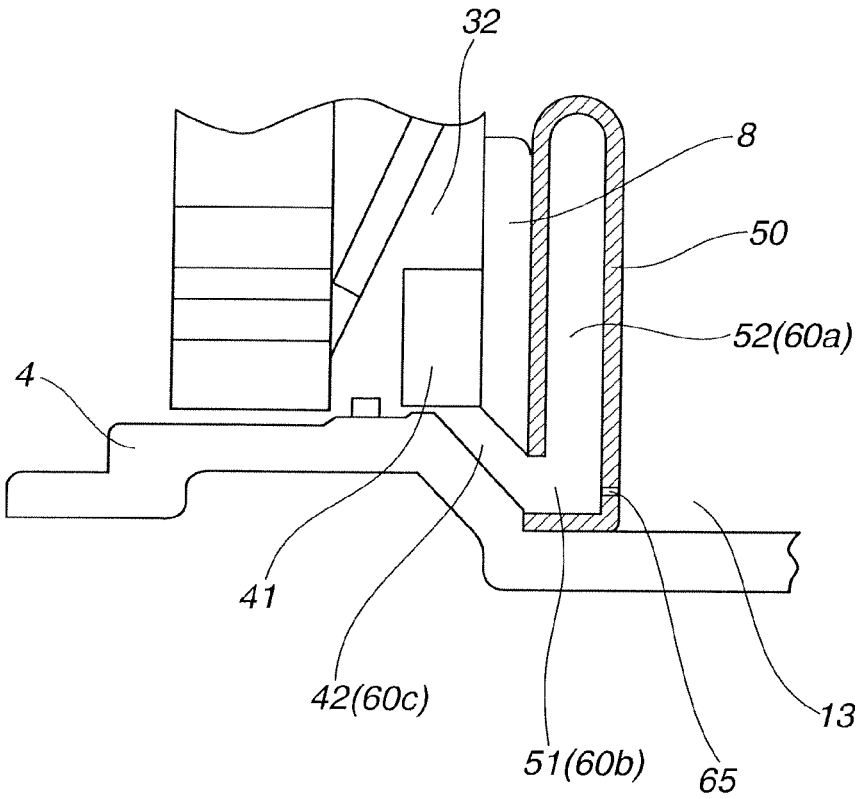
FIG. 5 is an enlarged view of the portion indicated by the line D in FIG. 1.

FIG. 1 is a vertically sectioned view of a horizontal type electrically driven gas compressor of a first embodiment, that is to be installed in an air conditioning device of a motor vehicle. FIG. 2 is a sectional view taken along the line A-A of FIG. 1. FIG. 3 is a sectional view taken along the line B-B of FIG. 1. FIG. 4 is a sectional view taken along the line C-C of FIG. 1. FIG. 5 is an enlarged view of the portion indicated by the line D in FIG. 1.

The horizontal type electrically driven gas compressor 1 of the first embodiment is installed in an air conditioning device of a motor vehicle and constitutes a refrigerant circulation system of refrigerating cycle together with a condenser, a liquid tank, an expansion valve and an evaporator which are components of the air conditioning device.

As is shown in FIG. 1, the horizontal type electrically driven gas compressor 1 is equipped with a housing 2, and the housing 2 includes a bottomed tubular front housing 3 that has one end opened and has a suction port 6 connected to the above-mentioned evaporator, a tubular center housing 4 that has both ends opened and has at an axially middle portion thereof a partition wall 8 to which a gas compression mechanism section 30 is fixed, and a bottomed tubular rear housing 5 that has one end opened and has a discharge port 9 connected to the above-mentioned condenser. It is to be noted that directions indicated by the double arrowhead line placed at a right position of FIG. 1 indicate up and down directions with respect to a condition wherein the compressor is properly set.

In the housing 2, there is defined a suction chamber 11 which is communicated with the suction port 6 and at a position nearer to the front housing 3 than the gas compression mechanism section 30 fixed to the partition wall 8 of the center housing 4. In the housing 2, there is also defined a discharge chamber 12 which is communicated with the discharge port 9 and placed at a position nearer to the rear housing 5 than the gas compression mechanism section 30 fixed to the partition wall 8 of the center housing 4.

An electric motor 20 is a brush less type DC motor and comprises a motor shaft 21 that is rotatably supported by a bearing 25 on an end wall 7 of the front housing 3 in a manner to rotate about an axis of the housing 2, a motor rotor 22 that is fixed to the motor shaft 21, and a stator 23 that is fixed to the front housing 3 in a manner to surround the motor rotor 22. The stator 23 is equipped with a coil 24, and to the front housing 3, there is hermetically connected a connector 26 for feeding the coil 24 with an electric power from the exterior.

As is shown in FIGS. 1 and 2, the gas compression mechanism section 30 constitutes a vane rotary type compressor which comprises a cylinder 31 of which inner surface constitutes a generally oval cross section, and a rotor 34 that is equipped with a plurality of vanes 35 and rotatably received in the cylinder 31, wherein by closing both ends of the cylinder 31 by a front side block 32 and a rear side block 33, there is defined a is generally oval cylinder chamber 36.

A shaft 34*b* of the rotor 34 has a rear part rotatably supported by a supporting portion 39 of a rear side block 33 and a front part rotatably supported by a supporting portion 38 of a front side block 32. The front part of the shaft 34*b* extends into the front housing 3 through the supporting portion 38 of the front side block 32 and is connected to the motor shaft 21.

The front side block 32, the cylinder 31 and the rear side block 33 are united by a plurality of bolts (not shown) and fixed to the partition wall 8 of the center housing 4. The partition wall 8 extends radially inward to a position near the supporting portion 38 of the front side block 32.

To the rear side block 33, there is connected an oil separator 33*a* that functions to separate a lubricating oil from the refrigerant discharged from the gas compression mechanism section 30.

When the rotor 34 is rotated together with the shaft 34*b* in response to rotation of the shaft 34*b*, the vanes 35 in the rotor 34 are forced to slide on a peripheral wall 36*a* of the cylinder chamber 36. With this, a plurality of compression chambers 37 are subjected to a volume change, each chamber being defined by a cylinder chamber peripheral wall 36*a*, a rotor outer peripheral surface 34*a*, side surfaces of the compression chamber of the front side block 32, side surfaces of the compression chamber of the rear side block 33 and each vane 35. In response to the volume change of the compression chamber 37, the gas compression mechanism section 30 intakes the refrigerant through the suction port 6, the suction chamber 11, an after-mentioned sucked refrigerant guide path 60 and inlet openings 32*a* and discharges the refrigerant, that has been compressed by the compression chambers 37, to the discharge chamber 12 through discharge ports 45 and the oil separator 33*a*.

The refrigerant discharged from the discharge ports 45 is forced to release the lubricating oil by the oil separator 33*a*. The refrigerant having the lubricating oil separated therefrom is discharged from the discharge port 9 to the refrigeration cycle side, and the lubricating oil having been separated from the refrigerant by the oil separator 33*a* is collected, by its own weight, in an oil reservoir 14 at the bottom of the discharge chamber 12, and due to a pressure difference produced in the housing 2, the lubricating oil is led to various portions in the gas compression mechanism section 30 to lubricate various sliding portions and acts as a back-pressure for the sliding movement of each vane 35 on the cylinder peripheral wall 36*a*.

The gas compression mechanism section 30 is supported by the front side block 32 at a position behind the partition wall 8 of the center housing 4. To a front side of the partition wall 8, there is connected a passage member 50. The front side block 32, the partition wall 8 and the passage member 50 constitute both a sucked refrigerant guide path 60 and a lubricating oil supply path 65.

As is seen from FIGS. 3 to 5, the front side block 32 is formed with two inlet openings 32*a* and 32*a* that are arranged generally horizontally at both sides of the shaft 34*b*. One axial end of each inlet opening 32*a* is exposed to the compression chambers 37, and the other axial end is closed by the partition wall 8, and the inlet openings 32*a* are connected to the suction chamber 11 through the sucked refrigerant guide path 60.

The front side block 32 is formed, at its surface directed toward the suction chamber 11, with grooves 40 and 40 that are arranged to extend downward from the inlet openings 32*a* and joined at their lowermost portions near a peripheral surface of the front side block 32.

The grooves 40 and 40 of the front side block 32 constitute passages when covered with the partition wall 8, and the passages constitute a fourth connecting passage part 60*d* that is a part of the sucked refrigerant guide path 60.

The center housing 4 is formed, at a portion extending from the partition wall 8 to the suction chamber 11, with a liquid reservoir space 13 of which bottom portion is enlarged in a radially outward direction. The partition wall 8 is formed at a bottom part thereof with a through opening 42 that extends in the direction of the thickness of the wall 8. An end of the through opening 42 near the suction chamber 11 is exposed to the liquid reservoir space 13 but closed by the passage member 50. The other end of the through opening 42, that is placed near the front side block 32, is connected to a united portion 41 between the two grooves 40 and 40. With this arrangement, there is produced a third connecting passage part 60*c* that is a part of the sucked refrigerant guide path 60.

To the partition wall 8 of the center housing 4 that faces the suction chamber 11, there is connected the above-mentioned passage member 50 in a manner to close the through opening 42, the passage member 50 constituting a part of the sucked refrigerant guide path 60. The passage member 50 is arranged to extend from a lower portion of the suction chamber 11 to an upper portion of the suction chamber 11 while detouring round the shaft 34*b*. The passage member 50 is a hollow member that is formed with a recessed portion 51 that is communicated with the through opening 42 of the partition wall 8 and a hole 52 that is communicated with the recessed portion 51. The hole 52 is directed upward at an upper portion of the suction chamber 11 and exposed to the suction chamber 11. By respectively connecting the recessed portion 51 and hole 52 of the passage member 50 to the through opening 42 of the partition wall 8 and the suction chamber 11, there are formed a second connecting passage part 60*b* and a first connecting passage part 60*a*.

In this first embodiment, the first, second, third and fourth connecting passage parts 60*a*, 60*b*, 60*c* and 60*d* constitute the sucked refrigerant guide path 60.

As is seen from FIG. 5, the passage member 50 is formed, at a part of the recessed portion 51 opposite to the partition wall 8, with a lubricating oil supply path 65 through which the lubricating oil in the liquid reservoir space 13 is led to the sucked refrigerant guide path 60. It is to be noted that a sectional area of the lubricating oil feeding passage 56 is set smaller than that of the sucked refrigerant guide path 60.

When, in the horizontal type electrically driven gas compressor 1 having the above-mentioned construction, the gas compressing mechanism section 30 is operated upon energization of the electric motor 20, a refrigerant having a lubricating oil contained therein is led from the suction port 6 to the suction chamber 11, and the refrigerant is forced to flow from a space provided near the end wall 7 of the suction chamber 11 toward the gas compression mechanism section 30 while cooling the electric motor 20. Furthermore, the refrigerant is guided to flow from an upper opening of the sucked refrigerant guide path 60, which is provided at an upper portion of the suction chamber 11, to the compression chambers 37 through the sucked refrigerant guide path 60 and the inlet openings 32*a* of the front side block 32, and after the refrigerant is compressed by the compression chambers 37, the same is discharged from the discharge port 9.

Part of the lubricating oil in the refrigerant flowing in the suction chamber 11 is separated from the refrigerant and collected in the liquid reservoir space 13 provided at the bottom of the suction chamber 11.

However, the lubricating oil collected in the liquid reservoir space 13 at the bottom of the suction chamber 11 is forced or guided to flow into the sucked refrigerant guide path 60 through the lubricating oil supply path 65 due to its own weight and a power of pressure difference between the interior of the suction chamber 11 and the interior of the sucked refrigerant guide path 60, which is caused by the flow of the refrigerant in the sucked refrigerant guide path 60.

As a result, the lubricating oil in the liquid reservoir space 13 provided at the bottom of the suction chamber 11 is forced to flow from the inlet openings 32*a* and 32*a* of the front side block 32 to the compression chambers 37 while being mixed with the refrigerant flowing in the sucked refrigerant guide path 60, and thus, undesired stagnation of the lubricating oil in the liquid reservoir space 13 at the bottom of the suction chamber 11 is avoided. Since the lubricating oil brought to the compression chambers 37 is the oil that has been suitably mixed with the refrigerant, undesired liquid compression that would be induced when only a liquid is fed to the compression chambers 37 is avoided and various sliding portions of the gas compression mechanism section 30 are suitably lubricated.

In the horizontal type electrically driven gas compressor 1 of the first embodiment, the refrigerant is guided to flow from the upper opening of the sucked refrigerant guide path 60 to the compression mechanism, while the lubricating oil collected in the liquid reservoir space 13 at the bottom of the suction chamber 11 is guided to flow to the sucked refrigerant guide path 60 through the lubricating oil supply path 65 due to its own weight and the power of pressure difference between the interior of the suction chamber 11 and the interior of the sucked refrigerant guide path 60, which is caused by the flow of the refrigerant in the sucked refrigerant guide path 60. Accordingly, undesired liquid compression that would be induced when only a liquid is fed to the compression chambers 37 is avoided and furthermore, even in a low speed operation condition, it never occurs that the lubricating oil and a liquefied refrigerant are collected in the liquid reservoir space 13 at the bottom of the suction chamber 11. As a result, increase in load application to the gas compression mechanism section 30 and electric motor 20 which would be caused by the liquid compression is avoided and thus reduction in reliability is avoided, and furthermore, malfunction of the gas compression mechanism section 30 due to reduction of lubricating oil supplied to the gas compression mechanism section 30 is also avoided.

Furthermore, in the horizontal type electrically driven gas compressor 1 of the first embodiment, a gas-liquid separation of the refrigerant is carried out in the suction chamber 11 and the separated liquid is supplied to the sucked refrigerant guide path 60 through the lubricating oil supply path 65. Thus, it is possible to remove a gas-liquid separator from a refrigerating cycle system that has used it between an evaporator and a compressor.

Second Embodiment

In the following, a second embodiment will be described.

Figure 6:
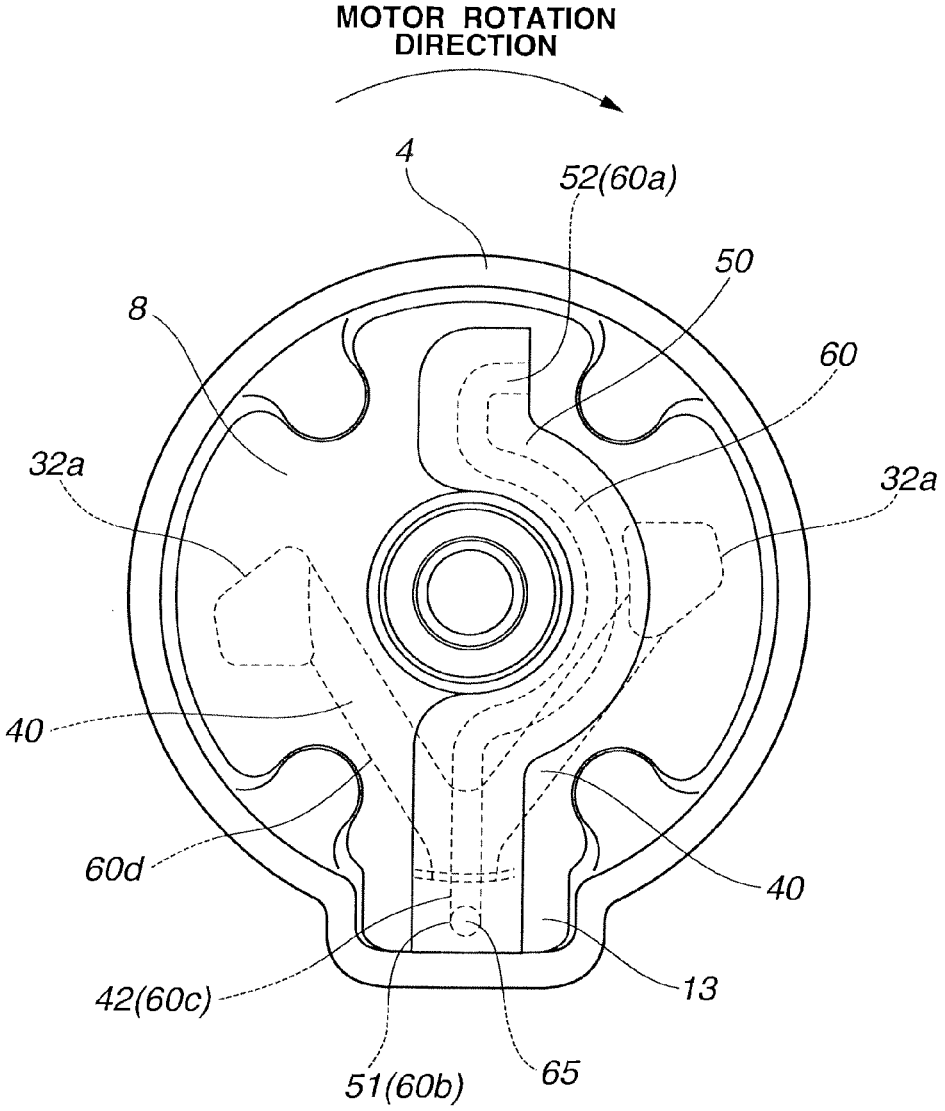
FIG. 6 is a sectional view similar or corresponding to FIG. 4 but showing a second embodiment of the present invention.

FIG. 6 is a sectional view of the second embodiment, which corresponds to the sectional view taken along the line C-C of FIG. 1.

In the second embodiment, the upper open end of the hole 52 of the passage member 50 that constitutes the sucked refrigerant guide path 60 is directed in a rotation direction of the electric motor 20 and exposed to the suction chamber 11.

Other portions of the second embodiment are substantially the same as those of the above-mentioned first embodiment.

When the refrigerant is forced to flow in the suction chamber 11 from the end wall 7 of the front housing 3 toward the gas compression mechanism section 30, the refrigerant is affected by the rotation of the electric motor 20. That is, the refrigerant is forced to flow in the suction chamber 11 while turning in the same direction as the rotation of the electric motor 20. Like the refrigerant, the lubricating oil contained in the refrigerant is also forced to flow while turning in the same direction as the rotation of the electric motor 20.

As is known, when the upper opening of the sucked refrigerant guide path 60 is directed in the rotation direction of the electric motor 20, effective feeding of the refrigerant and/or the lubricating oil into the sucked refrigerant guide path 60 needs a reverse of the rotation direction in which the refrigerant and/or lubricating oil flows. Accordingly, in case of the lubricating oil of which specific gravity is higher than that of the refrigerant, flowing of the lubricating oil into the path 60 is difficult as compared with the refrigerant due to the size of its inertia force.

As a result, in the sucked refrigerant guide path 60, the refrigerant mainly flows, and thus, the amount of the lubricating oil that is contained in the refrigerant in the sucked refrigerant guide path 60 is directly decided by the amount of the lubricating oil that is guided by the lubricating oil supply path 65. This means that the amount of the lubricating oil in the sucked refrigerant is stably controlled.

In the above-mentioned first embodiment, a reservoir space 13 is produced by enlarging the bottom portion of the suction chamber 11 in a radially outward direction and the lubricating oil supply path 65 is connected to the reservoir space 13. However, if desired, the lubricating oil supply path 65 may be directly connected to the bottom portion of the suction chamber 11 without employment of the reservoir space 13.

In the above-mentioned embodiments, a vane rotary type compressor is used as the gas compression mechanism. However, if desired, an eccentric vane rotary type compressor, a scroll type compressor, a rolling piston type compressor and the like may be employed as the gas compression mechanism.

DESCRIPTION OF REFERENCE NUMERALS

1 . . . horizontal type electrically driven gas compressor
2 . . . housing
3 . . . front housing
4 . . . center housing
5 . . . rear housing
8 . . . partition wall
11 . . . suction chamber
12 . . . discharge chamber
20 . . . electric motor
30 . . . gas compression mechanism section
31 . . . cylinder
32 . . . front side block
33 . . . rear side block
34 . . . rotor
35 . . . vane
36 . . . cylinder chamber
37 . . . compression chamber
40 . . . groove
42 . . . through opening
50 . . . passage member
51 . . . recessed portion
52 . . . hole
60 . . . sucked refrigerant guide path
65 . . . lubricating oil supply path

The invention claimed is:

1. A horizontal type electrically driven gas compressor comprising:

an electric motor installed in a suction chamber defined in a housing, the suction chamber being communicated with a suction port provided by the housing;

a gas compression mechanism section installed in the housing and driven by the electric motor;

a sucked refrigerant guide path for guiding a lubricating oil-impregnated refrigerant from the suction chamber to the gas compression mechanism section, the sucked refrigerant guide path including one open end exposed to an upper portion of the suction chamber, a middle portion running through a bottom portion of the suction chamber and an other open end connected to an inlet opening of the gas compression mechanism section; and a lubricating oil supply path for supplying a lubricating oil, which has been collected in the bottom portion of the suction chamber, to the sucked refrigerant guide path, the lubricating oil supply path fluidly connecting the sucked refrigerant guide path and the bottom portion of the suction chamber at the position of the bottom portion of the suction chamber.

2. The horizontal type electrically driven gas compressor as claimed in claim 1, in which the one open end of the refrigerant guide path is oriented to face in the rotation direction of the electric motor and exposed to the suction chamber.

* * * * *

UNITED STATES PATENT AND TRADEMARK OFFICE

CERTIFICATE OF CORRECTION

PATENT NO. : 8,944,781 B2
APPLICATION NO. : 13/636932
DATED : February 3, 2015
INVENTOR(S) : Hirotada Shimaguchi and Toshiharu Watanabe It is certified that error appears in the above-identified patent and that said Letters Patent is hereby corrected as shown below:

On the Title Page

Insert the following:

-- (56) References Cited

"FOREIGN PATENT DOCUMENTS"

CN 1470767A 1/2004 --.

Signed and Sealed this
Eighteenth Day of August, 2015

Michelle K. Lee

Michelle K. Lee
*Director of the United States Patent and Trademark Office*